United States Patent [19]

Tharman

[11] Patent Number: 4,986,228

[45] Date of Patent: Jan. 22, 1991

[54] LOW OIL PRESSURE INTERLOCK SWITCH

[75] Inventor: Paul A. Tharman, Milwaukee, Wis.

[73] Assignee: Briggs & Stratton Corporation, Wauwatosa, Wis.

[21] Appl. No.: 430,600

[22] Filed: Nov. 1, 1989

[51] Int. Cl.[5] ..... F02P 11/02

[52] U.S. Cl. ..... 123/179 BG; 123/630; 123/196 S; 123/198 DC

[58] Field of Search ..... 123/179 BG, 179 B, 179 A, 123/196 S, 198 DC, 630

[56] References Cited

U.S. PATENT DOCUMENTS

| | | | |
|---|---|---|---|
| 2,722,673 | 11/1955 | Turner | 340/52 |
| 3,356,082 | 12/1967 | Jukes . | |
| 3,521,612 | 7/1970 | Santi et al. | 123/179 |
| 3,581,720 | 6/1971 | Hemphill et al. . | |
| 3,601,103 | 8/1971 | Swiden | 123/198 D |
| 3,726,265 | 4/1973 | Howard | 123/179 K |
| 3,731,471 | 5/1973 | Bening | 56/10.5 |
| 3,733,794 | 5/1973 | Allen | 56/10.5 |
| 4,033,311 | 7/1977 | Burson | 123/179 K |
| 4,034,732 | 7/1977 | Van Burkleo | 123/198 DC |
| 4,054,117 | 10/1977 | Palmer et al. | 123/198 D |
| 4,059,087 | 11/1977 | Tanigami et al. | 123/196 S |
| 4,144,862 | 3/1979 | Estkowski | 123/196 S |
| 4,147,151 | 4/1979 | Wright | 123/198 DC |
| 4,294,327 | 10/1981 | Howard | 180/273 |
| 4,369,745 | 1/1983 | Howard | 123/198 DC |
| 4,445,470 | 5/1984 | Chmielewski | 123/196 S |
| 4,489,311 | 12/1984 | Lang et al. | 340/501 |
| 4,522,170 | 6/1985 | Lenk et al. | 123/198 DC |
| 4,622,935 | 11/1986 | Janisch | 123/198 DC |
| 4,684,917 | 8/1987 | Tharman | 340/59 |
| 4,754,732 | 7/1988 | Kuczenski et al. | 123/196 S |
| 4,794,897 | 1/1989 | Kinouchi | 123/196 S |

FOREIGN PATENT DOCUMENTS

| | | | |
|---|---|---|---|
| 57-200671 | 12/1982 | Japan | 123/630 |

*Primary Examiner*—Andrew M. Dolinar

*Attorney, Agent, or Firm*—Andrus, Sceales, Starke & Sawall

[57] ABSTRACT

An ignition-powered interlock switch is provided for disabling a low oil pressure switch in power-driven apparatus such as lawn mowers, pumps, generators, tractors and the like. The interlock switch disables the low oil pressure switch when the engine is not running to permit the engine to be easily started. The interlock switch preferably comprises a diode, a relay, and a capacitor connected in parallel with the relay solenoid. The capacitor discharges through the relay solenoid after the engine stops running to operate the relay. The interlock switch may also include either a manual or an electronic switch.

3 Claims, 2 Drawing Sheets

LOW OIL PRESSURE INTERLOCK SWITCH

BACKGROUND OF THE INVENTION

The present invention relates to low oil pressure switches which shut off an engine when the oil pressure is below a predetermined level. More particularly, the invention relates to an interlock switch for disabling the low oil pressure switch to permit the engine to be easily started.

Various types of low oil pressure switches are known which activate when the engine oil pressure is below a predetermined level. Some of these prior art switches are connected to indicator systems that provide an audible or visual signal when the oil pressure is too low.

When other types of oil pressure switches activate, they cause the engine to shut off to prevent engine damage. One such oil pressure switch is connected in series with the primary winding of the ignition system's main core, and is normally open. This type of switch closes when the oil pressure is below a predetermined level, thereby grounding the ignition pulse and stopping the engine.

Another type of oil pressure switch is normally closed when the engine is running. The switch then opens when the oil pressure is below a predetermined level, causing the engine to shut down.

A major problem with both of the above-referenced shut-off switches is that the engine is thereafter difficult to start. Since the engine has been shut off due to low oil pressure, it is very difficult to generate a sufficient oil pressure by pulling or cranking the engine to then cause the oil pressure switch to deactivate. Moreover, such low oil pressure shut-off switches typically activate while the engine is being shut off for any reason since the sensed oil pressure is low as the engine is winding down. In addition, the operator may not know why the ne will not start, and may attempt to find other possible problems with the engine which prevent it from starting.

It is thus desirable to provide a means for starting an engine which has been shut down, and at the same time to indicate to the operator that the oil pressure is low.

SUMMARY OF THE INVENTION

An ignition-powered interlock switch is provided for disabling a low oil pressure switch in power-driven apparatus such as lawn mowers, pumps, generators, tractors and the like that have an internal combustion engine. The engine includes an ignition system having a main core that supports the primary winding and a secondary winding, with the interlock switch being powered by the primary winding. In a preferred embodiment, an indicator means also informs the operator of the low oil condition.

The interlock switch means according to the present invention is interconnected with both the primary winding of the main core and with the low oil pressure switch, and disables the low oil pressure switch when the engine is not running. In a first embodiment used with a normally open low oil pressure switch, the interlock switch means comprises a diode having its anode connected in series with the primary winding; a first switch means, which may be a relay switch, connected to the low oil pressure switch, for closing after the engine starts running and for opening after the engine stops running; and a capacitor connected in series with the cathode of the diode and in parallel with the relay solenoid. The capacitor discharges through the relay solenoid after the engine stops running to open the relay contacts.

In a second embodiment used with a normally closed low oil pressure switch, the interlock switch means comprises a diode having its anode connected in series with the primary winding; a first switch means, which may be a relay switch, connected to the low oil pressure switch, for opening after the engine starts running and for closing after the engine stops running; and a capacitor connected in parallel with the relay solenoid. The capacitor discharges through the relay solenoid after the engine stops running to close the relay contacts.

In either embodiment, the relay switch may be an electronic switch such as an SCR, a diac, a triac, a transistor, or other semiconductor switch. The interlock switch means may also include a manual switch activated by the operator before the engine is started.

Also in a preferred embodiment, an indicator means, powered by the ignition pulse and connected to the low oil pressure switch, is used for visually or audibly indicating to the operator when the engine oil pressure is below a predetermined level. The indicator means may comprise a buzzer or a light emitting diode (LED). If an LED is used, a shunt resistor is preferably connected in parallel with the LED to protect the LED from an overcurrent condition caused by the ignition pulse.

It is a feature and advantage of the present invention to provide a circuit for disabling or deactivating a low oil pressure switch to enable an internal combustion engine to be easily started.

It is yet another feature and advantage of the present invention to provide an interlock switch means that is powered by the ignition pulse.

It is another feature and advantage of the present invention to provide a visual or audible indicator means, powered by the ignition pulses, for informing the operator that the engine oil pressure is below a predetermined level.

These and other features and advantages of the present invention will be apparent to those skilled in the art from the following detailed description and the attached drawings, in which:

DESCRIPTION OF THE PREFERRED EMBODIMENTS

Figure 1:
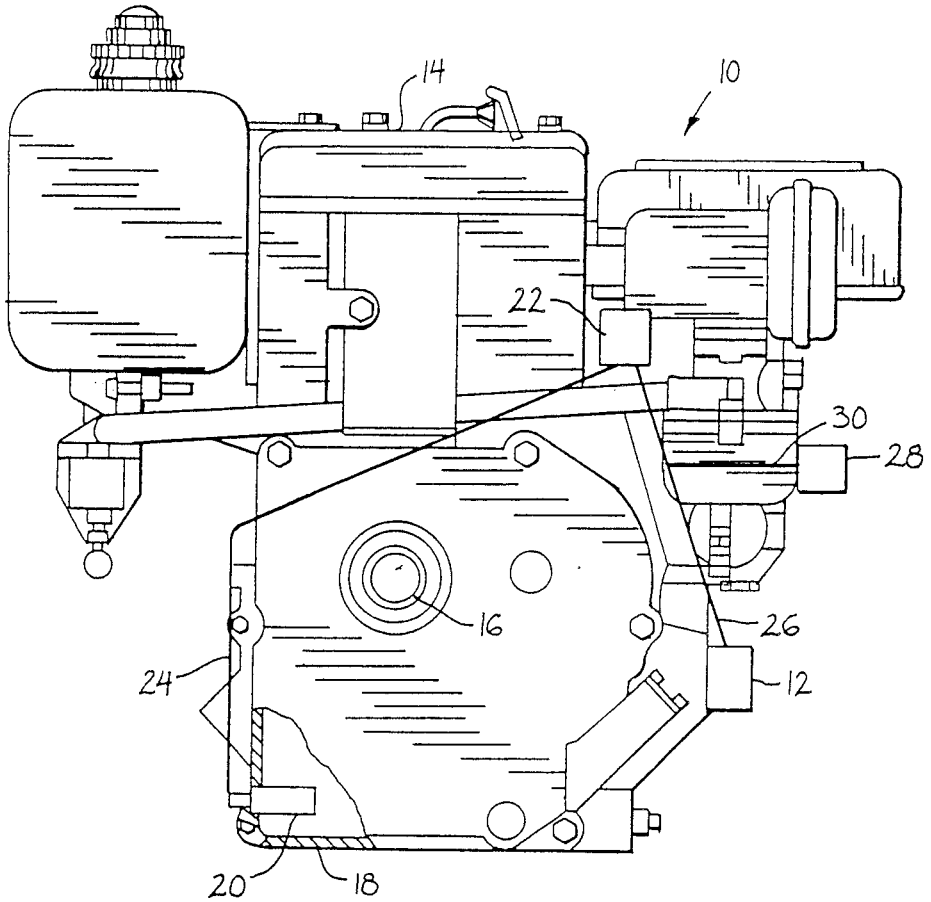
FIG. 1 is a schematic drawing of a generator incorporating the ignition-powered interlock switch means of the present invention.

Referring now to FIG. 1, the principles of the invention are illustrated as being applied to a breakerless magneto-ignition system for a single cylinder internal combustion engine that drives a generator 10. Although the principles of the invention are illustrated as being applied to magneto-ignition systems of the type used for powering tractors, lawn mowers, pumps, electrical generators, snow blowers and the like, the invention may be used with battery powered ignition systems as well.

The ignition system of FIG. 1 includes a conventional magneto armature (not shown) having an induction coil consisting of a primary winding 12 that has a relatively small number of turns of relatively coarse wire, and a secondary winding (not shown) having numerous turns of relatively fine wire. The primary and secondary windings are inductively coupled with one another in a conventional manner by means of a ferromagnetic core (not shown) on which they are both wound. A spark plug (not shown) is connected across the terminals of the secondary winding. Although the invention is illustrated as being applied to a single cylinder internal combustion engine having only one spark plug, the invention may be used with engines having a plurality of spark plugs successively connected with the secondary winding in a known manner by means of a conventional distributor used with multi-cylinder engines.

To fire the spark plug, a circuit is closed to permit current to flow in the primary winding. That circuit remains closed at least long enough for the current flow in the primary winding to attain its full value, and is abruptly opened at the time the spark plug is to be fired, yielding a rapid collapse of the flux field that had been induced in the core by the current flow. The collapsing flux induces across the secondary winding a voltage high enough to produce an arc across the electrode to the spark plug, in a conventional manner.

Assuming that the present invention is incorporated into a single cylinder engine having a breakerless magneto-ignition system, the operation of the magneto requires that a circuit between the terminals of the primary winding be closed and opened by switching means operated in properly timed relation to the engine cycle. In the breakerless magneto-ignition system, the mechanically actuated breaker points for controlling the flow of current to the primary winding are replaced by electronic switching means comprising a transistor device (not shown) and a small biasing coil (not shown) wound upon a second ferromagnetic core (not shown). The biasing coil and its corresponding second core cooperate with a permanent magnet assembly carried for orbital motion on a flywheel mounted on the engine crankshaft. The crankshaft rotates in timed relation to the engine cycle. The operation of the transistor device and biasing coil in cooperation with the armature core and permanent magnet assembly is described in detail in U.S. Pat. No. 4,270,509 to Paul A. Tharman, the subject matter thereof being specifically incorporated by reference herein.

Referring again to FIG. 1, generator 10 typically includes an internal combustion engine 14 having a crankshaft 16 and a crankcase 18 that contains oil or another lubricant for engine 14.

An ignition pulse from ignition primary 12 powers interlock switch means 28 via lines 26 and 30. Indicator means 22 is also powered by ignition pulses from ignition primary winding 12 via line 26. Indicator means 22 may consist of a buzzer, or an LED having a 1 ohm parallel resistor to protect the LED from the high current in the ignition pulses. Oil crankcase 18 includes an oil pressure switch 20 which is connected to, and powered by, ignition primary 12 via lines 24 and 26. Oil pressure switch 20 is also connected to indicator means 22 via line 24. In one embodiment, corresponding to FIG. 2, oil pressure switch 20 is open when engine 14 is running, but closed when the oil pressure in crankcase 18 is below a predetermined level. In another embodiment, corresponding to FIG. 3, low oil pressure switch 20 is closed when engine 14 is running but opens when the oil pressure in crankcase 18 is below a predetermined level.

Figure 2:
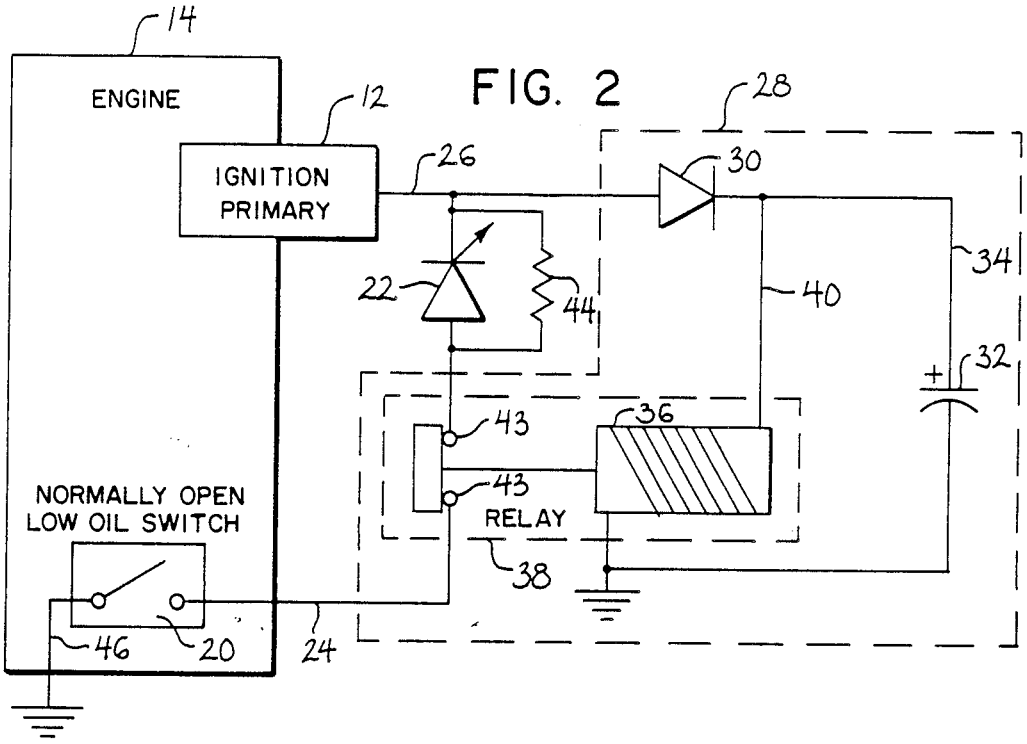
FIG. 2 is a schematic drawing of a preferred embodiment of the present invention in which a normally open type of low oil pressure switch is used.

Referring now to FIG. 2, the high voltage side of ignition primary winding 12 of engine 14 powers the normally open low oil pressure switch 20, LED 22, and interlock switch means 28. Ignition primary 12 is connected to low oil pressure switch 20 via lines 26 and 24. Ignition primary 12 powers LED 22 via line 26. Interlock switch means 28 is powered by ignition primary 12 via line 26.

Interlock switch means 28 preferably comprises a diode 30 whose anode is connected in series via line 26 with ignition primary 12, and whose cathode is connected to both a large electrolytic capacitor 32 via line 34, and to relay solenoid 36 of relay switch 38 via line 40. Capacitor 32 also helps smooth the half-wave rectified direct current from diode 30 so that relay 38 may operate on direct current. Relay solenoid 36 and capacitor 32 are connected in parallel. Relay 38 also includes normally closed relay contacts 43 which are closed after the engine starts running, and are opened to disable low oil pressure switch 20 after the engine stops running.

Interlock switch means 28, consisting of diode 30, capacitor 32, and first switch means or relay 38, may be replaced by a manual switch. Relay 38 could be replaced by a semiconductor switch such as an SCR, diac, triac, transistor, or the like.

The embodiment depicted in FIG. 2 also includes an indicator means consisting of light emitting diode 22 and a parallel resistor 44. Resistor 44 is preferably a 1 ohm shunt resistor which protects LED 22 from burnout due to the magnitude of the ignition pulse appearing on line 26 and also allows shutdown of the engine if the LED does burnout. The indicator means may be replaced by another type of visual or audible indicator. The purpose of the indicator means is to inform the operator that a low oil pressure condition exists, even though oil pressure switch 20 is disabled and the engine is in the process of being started.

The circuit depicted in FIG. 2 operates as follows. When the oil pressure in engine 14 is above the predetermined potentially damaging level, switch 20 is open. This allows ignition primary winding 12, which is inductively coupled with a secondary winding (not shown) as discussed above, to generate ignition pulses to operate the engine.

When the oil pressure in engine 14 is below the predetermined level, switch 20 closes, causing the ignition pulse from ignition primary winding 12 to be shorted to ground via lines 26, 24 and 46. This stops the engine. Once the engine is stopped, it typically would be difficult to restart the engine since pulling or cranking the engine will not raise the oil pressure sufficiently to open switch 20.

Interlock switch means 28 disables low oil pressure switch 20, thereby preventing the ignition pulse from being shorted to ground. In the preferred embodiment depicted in FIG. 2, interlock switch means 28 operates as follows. When engine 14 is running, ignition pulses from ignition primary winding 12 are fed via line 26, diode 30, and line 34 to charge capacitor 32 and solenoid 36. One suitable relay for Briggs & Stratton engines is a 5 or 6 volt relay, such as a Clare PRMA1A05, whose contacts close at about 800 to 1,400 revolutions per minute (RPM). The closing of relay contacts 43 allows low oil pressure switch 20 to be in the circuit.

After engine 14 stops running, capacitor 32 discharges through solenoid 36, causing relay contacts 43 to open. The opening of relay contacts 43 takes low oil pressure switch 20 out of the ignition circuit, thereby preventing ignition pulses from ignition primary 12 from being grounded via line 46. Low oil pressure switch 20 typically closes after the engine stops running because the engine oil pressure then falls below the predetermined level. If switch 20 is closed, the ignition pulses will cause LED 22 to light, indicating that a low oil condition exists. When switch 20 is taken out of the circuit, ignition pulses from ignition primary 12 are generated in their usual manner, and charge capacitor 32 and solenoid 36 for the next time that the engine stops.

Figure 3:
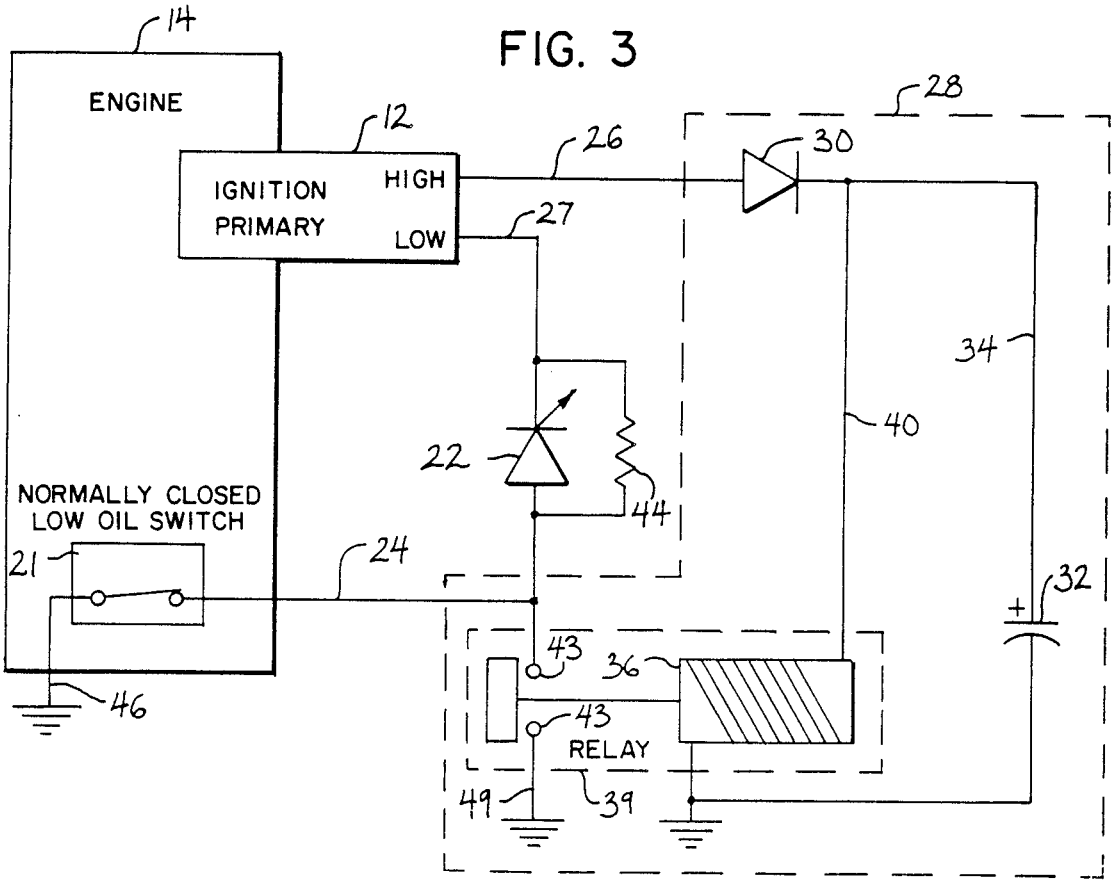
FIG. 3 is a schematic drawing of a preferred embodiment of the present invention in which a normally closed type of low oil pressure switch is used.

FIG. 3 depicts another preferred embodiment of the present invention. The embodiment depicted in FIG. 3 is used with low oil pressure switches which are normally closed while engine 14 is running. In FIG. 3, components having corresponding functions with components in FIG. 2 have been given the same numerical designations.

Referring now to FIG. 3, engine 14 has an ignition primary winding 12 whose high voltage side is connected to the anode of diode 30 via line 26. The cathode of diode 30 is connected to solenoid 36 of relay 39 via line 40. Solenoid 36 and capacitor 32 are in parallel. Relay 39 also includes relay contacts 43. Relay contacts 43 are normally open when the engine is running, and close after the engine stops running.

The low voltage side of ignition primary 12 is connected to LED 22 and parallel shunt resistor 44 via line 27. The normally closed low oil pressure switch 21 is connected to the low voltage side of ignition primary 12 via line 27, LED 22, resistor 44, and line 24.

The circuit depicted in FIG. 3 operates as follows. When a low oil condition is sensed when there is an oil leak, the oil level is low, or when the engine stops running, switch 21 opens. Subsequent cranking or pulling of the engine to start it will cause ignition pulses from ignition primary 12 to charge capacitor 32 via lines 26 and 34, while simultaneously charging solenoid 36 via lines 26, diode 30, and line 40. Relay contacts 43 close after the engine stops running, causing the low voltage side of ignition primary 12 to be grounded through line 49. The grounding of the low voltage side of primary 12 takes switch 21—which is now open—out of the ignition circuit, enabling the engine to start. The grounding of the low voltage side of primary 12 causes LED 22 to light, with shunt resistor 44 protecting LED 22 against an overcurrent condition. While the engine is running, ignition pulses charge capacitor 32 and solenoid 36, causing relay contacts 43 to be open. After the engine stops running, capacitor 32 discharges through solenoid 36, causing relay contacts 43 to close.

Several embodiments of the present invention have been discussed above and depicted in the drawings. However, additional alternate embodiments will be apparent to those skilled in the art and are contemplated as being within the scope of the present invention. Therefore, the scope of the present invention is to be limited only by the following claims and their equivalents.

I claim:

1. In an apparatus having an internal combustion engine and an ignition system having a main core that includes a primary winding to produce an ignition pulse, and having a low oil pressure switch which activates when the engine oil pressure is below a predetermined level, the improvement comprising:

an interlock switch means, interconnected with both said primary winding and said low oil pressure switch, for disabling said low oil pressure switch when the engine is not running, said interlock switch means comprising:

a diode having its anode connected in series with said primary winding;

a first switch means, connected to said low oil pressure switch, for closing after said engine starts running and for opening after said engine stops running; and a capacitor connected in series with the cathode of said diode, said capacitor discharging through said first switch means after said engine stops running to open said first switch means.

2. The improvement of claim 1, wherein said first switch means is a relay switch whose contacts close after the engine starts running and open after the engine stops running.

3. The improvement of claim 1, wherein said first switch means opens when the engine speed is between about 800 to 1,400 revolution per minute (RPM).

* * * * *

UNITED STATES PATENT AND TRADEMARK OFFICE

CERTIFICATE OF CORRECTION

PATENT NO. : 4,986,228

DATED : January 22, 1991

INVENTOR(S) : PAUL A. THARMAN

It is certified that error appears in the above-identified patent and that said Letters Patent is hereby corrected as shown below:

Claim 3, column 6, line 46, delete "revolution" and substitute therefore ---revolutions---.

Signed and Sealed this

Twelfth Day of May, 1992

*Attest:*

DOUGLAS B. COMER

*Attesting Officer*

*Acting Commissioner of Patents and Trademarks*